US006067951A

United States Patent [19]

Kitajima

[11] Patent Number: 6,067,951

[45] Date of Patent: May 30, 2000

[54] ENGINE FOR OUTBOARD MOTOR

[75] Inventor: Kazuyuki Kitajima, Hamamatsu, Japan

[73] Assignee: Sanshin Kogyo Kabushiki Kaisha, Hamamatsu, Japan

[21] Appl. No.: 09/111,442

[22] Filed: Jul. 7, 1998

[30] Foreign Application Priority Data

Jul. 7, 1997 [JP] Japan ..... 9-181500

[51] Int. Cl.[7] ..... B63H 20/00

[52] U.S. Cl. ..... 123/196 R; 123/196 W; 184/6.5

[58] Field of Search ..... 123/196 R, 196 W, 123/195 P, 41.33, 41.42, 90.33, 90.34, 90.38; 184/6.5, 6.26, 11.1

[56] References Cited

U.S. PATENT DOCUMENTS

| | | | |
|---|---|---|---|
| 4,474,146 | 10/1984 | Shimizu et al. | 123/90.34 |
| 4,545,332 | 10/1985 | Suzuki et al. | 123/41.01 |
| 4,790,273 | 12/1988 | Oguri et al. | 123/196 W |
| 4,969,434 | 11/1990 | Nakgawa | 123/196 M |
| 5,163,394 | 11/1992 | Koishikawa et al. | 123/196 W |
| 5,213,074 | 5/1993 | Imagawa et al. | 123/196 M |
| 5,687,686 | 11/1997 | Takahashi | 123/195 P |
| 5,860,403 | 1/1999 | Hirano et al. | 132/196 R |

*Primary Examiner*—Henry C. Yuen
*Assistant Examiner*—Hieu T. Vo
*Attorney, Agent, or Firm*—Knobbe, Martens, Olson & Bear LLP

[57] ABSTRACT

An improved and simplified outboard motor construction wherein the cooling and exhaust systems for the engine are formed with a minimum number of components and sealing joints. The exhaust system includes an elongated expansion chamber formed in the drive shaft housing. In addition, the drive shaft housing has a cylindrical section that is journaled within a swivel bracket for its steering movement. The volume between the external portion of the drive shaft housing and the internal portion of the swivel bracket forms a second expansion chamber that is employed for the low speed above the water exhaust gas discharge. The flow of cooling the water to and from the engine is controlled so that the exhaust gas interchange area between the power head and the drive shaft housing will be well cooled, as will the oil reservoir for the engine and the oil returned to it.

12 Claims, 11 Drawing Sheets

ENGINE FOR OUTBOARD MOTOR

BACKGROUND OF THE INVENTION

This invention relates to an engine for an outboard motor and more particularly to an improved lubricating system for a four-cycle, outboard motor engine.

Two-cycle internal combustion engines have been frequently used as the prime mover for an outboard motor. The reason for the use of two-cycle engines is because of their compact nature and their high specific output. These features are particularly important in an outboard motor due to the very compact nature of such a propulsion device.

However, with increasing concerns about environmental protection, there has been a growing interest in the application of four-cycle engines for many applications that previously utilized two-cycle engines because of their aforenoted advantages. One of the advantages of four-cycle engines over two-cycle engines is also a feature that gives some disadvantages in connection with outboard motor application.

With two-cycle engines, the lubricating oil for the engine is generally consumed during engine running. That is, although two-cycle engines may use direct lubricating systems, the oil used for lubrication nevertheless is consumed during engine operation and any residual amounts is discharged to the atmosphere. This obviously has some environmental problems.

However, the recycled lubricating system utilized commonly with four-cycle engines presents some problems in application to outboard motors. That is, it is necessary to provide not only an oil reservoir, but also a system for circulating the oil to the various components of the engine to be lubricated.

Due to the fact that the exhaust gases are discharged from the engine through an exhaust system that is formed primarily within the drive shaft housing and lower unit of the outboard motor, it is sometimes difficult to isolate the oil reservoir for the engine from the exhaust system.

It is, therefore, a principal object of this invention to provide an improved lubricating system for a four-cycle engine utilized in an outboard motor.

It is a further object of this invention to provide an oil lubricating system for an outboard motor having a four-cycle engine wherein the lubricant for the engine is circulated in such a way so as to maintain adequate cooling for it.

In order to maintain simplicity of the engine and low cost, particularly in small displacements, resort may be had to splash lubricating system. Where splash lubricating systems are employed and the engine employs overhead valves to obtain better performance, it is necessary to deliver the lubricant to the cylinder head area for lubricating the valve actuating mechanism. This oil then must be returned to the reservoir. Because of this flow path, there increases the likelihood that the oil may be positioned in proximity to the exhaust system of the engine. It is, therefore, a still further object of this invention to provide an oil return system for an overhead valve four-cycle engine wherein the returned oil is also cooled.

SUMMARY OF THE INVENTION

This invention is adapted to be embodied in a four-stroke internal combustion engine having a crankcase chamber, a cylinder head and a cylinder block. A valve mechanism is contained in the cylinder head for operating valves associated with a cylinder bore formed in the cylinder block. A valve actuating mechanism is contained within a valve cover that is attached to the cylinder head. A lubrication system is provided for delivering lubricant to the valve actuating mechanism. A return passage extends from the cylinder head through the cylinder block to the crankcase chamber for returning lubricant to the crankcase chamber from the valve chamber. The engine is provided with a cooling jacket and liquid coolant is introduced to this cooling jacket through a coolant delivery passage that is disposed in proximity to the oil return passage for cooling the returned oil.

DETAILED DESCRIPTION OF THE PREFERRED EMBODIMENT

Figure 1:
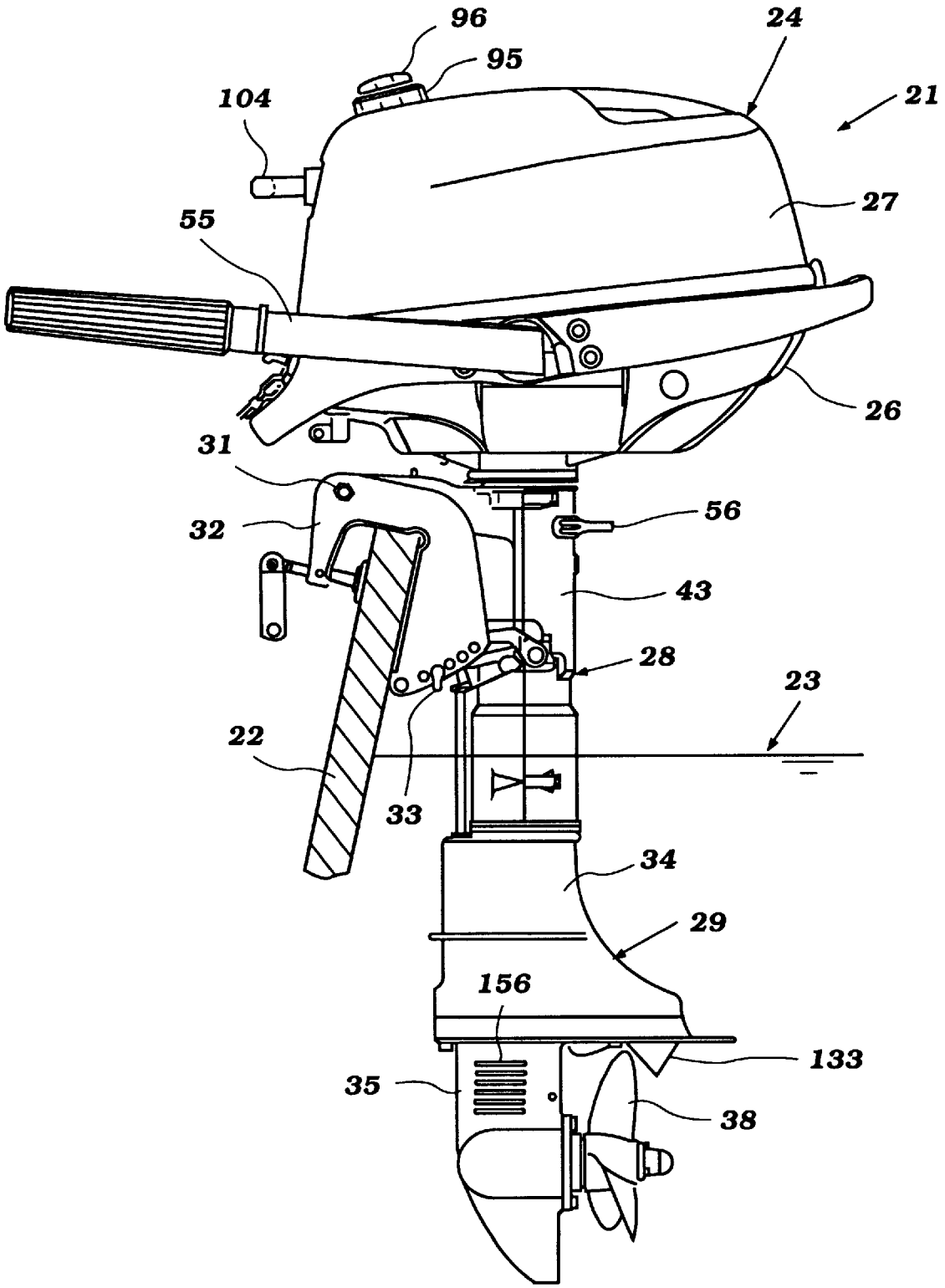
FIG. 1 is a side elevational view of an outboard motor constructed in accordance with an embodiment of this invention, shown attached to the transom of a watercraft, both illustrated in cross-section, and at rest in a body of water in which the watercraft is operating.
Figure 2:
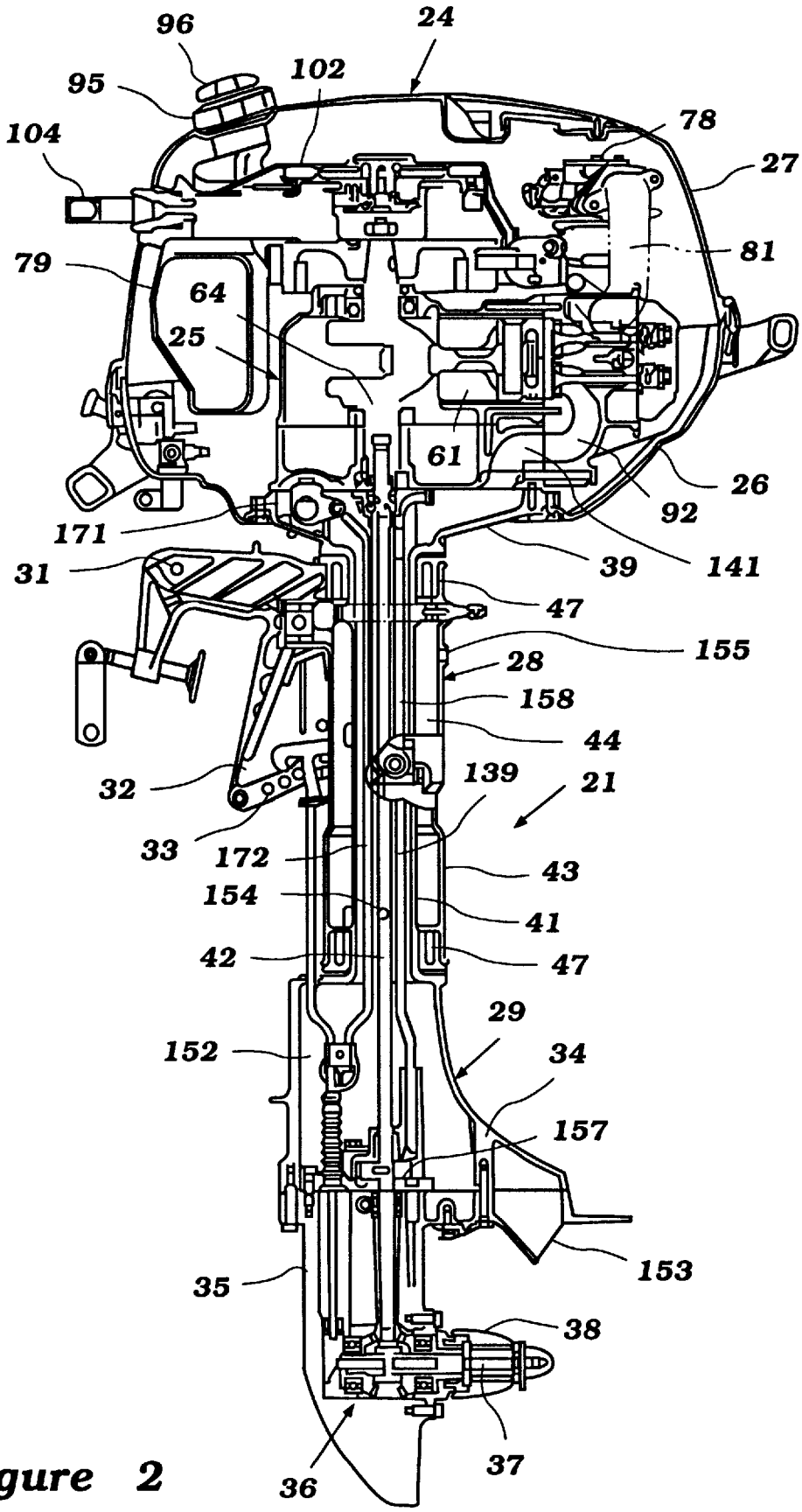
FIG. 2 is a view looking in the same direction as FIG. 1, but shows certain components of the outboard motor broken away and in section.

Referring now in detail to the drawings and initially primarily to FIGS. 1 and 2, an outboard motor constructed in accordance with an embodiment of the invention is identified generally by the reference numeral 21. The outboard motor 21 is shown as being attached to the transom of an associated watercraft The transom is shown only partially in cross-section and indicated by the reference numeral 22.

The watercraft with which the transom 22 is associated and outboard motor 21 are designed so as to be operated in a body of water, indicated at 23 in FIG. 1. The water level 23 illustrated in FIG. 1 is the water level when the watercraft is relatively stationary. The watercraft is of the planing type and as its speed increases, the degree of submersion of the outboard motor will be reduced, as is well known in this art.

The outboard motor 21 is comprised of a power head portion, indicated generally by the reference numeral 24. The power head portion 24 includes a four cycle, internal combustion engine, which appears partially in cross-section in FIG. 2 and which is identified by the reference numeral 25. The power head is completed primarily by a protective cowling that is comprised of a lower tray portion 26 and an upper main cowling portion 27.

The outboard motor 21 includes a swivel bracket, indicated generally by the reference numeral 28. This swivel bracket 28 is generally a tubular member which supports a drive shaft housing and lower unit assembly, indicated generally by the reference numeral 29, in a manner to be described. This unit assembly 29 is mounted, in a manner to be described, in the swivel bracket 28 so that it rotatably journals the drive shaft housing and lower unit 29 and thus the outboard motor 21 for steering about a vertically extending axis.

The swivel bracket 28 is, in turn, connected by means of a pivot pin 31 to a clamping bracket 32. This pivotal connection permits tilt and trim adjustment of the outboard motor 21 about the pivot pin 31 relative to the hull transom 22. A trim pin arrangement 33 permits selective setting of the trim angle.

The drive shaft housing and lower unit 29 includes a lower housing portion 34 to which is fixed a lower unit housing 35 that contains a conventional bevel gear reversing transmission, indicated generally by the reference numeral 36. This bevel gear transmission 36 can selectively be coupled to a propeller shaft 37 that is journaled in the lower unit 35 in any suitable fashion. The control for this transmission 36 will be described later, but any known system may be employed. A propeller 38 is affixed to the propeller shaft 37 for propelling the watercraft in a well known manner.

Figure 3:
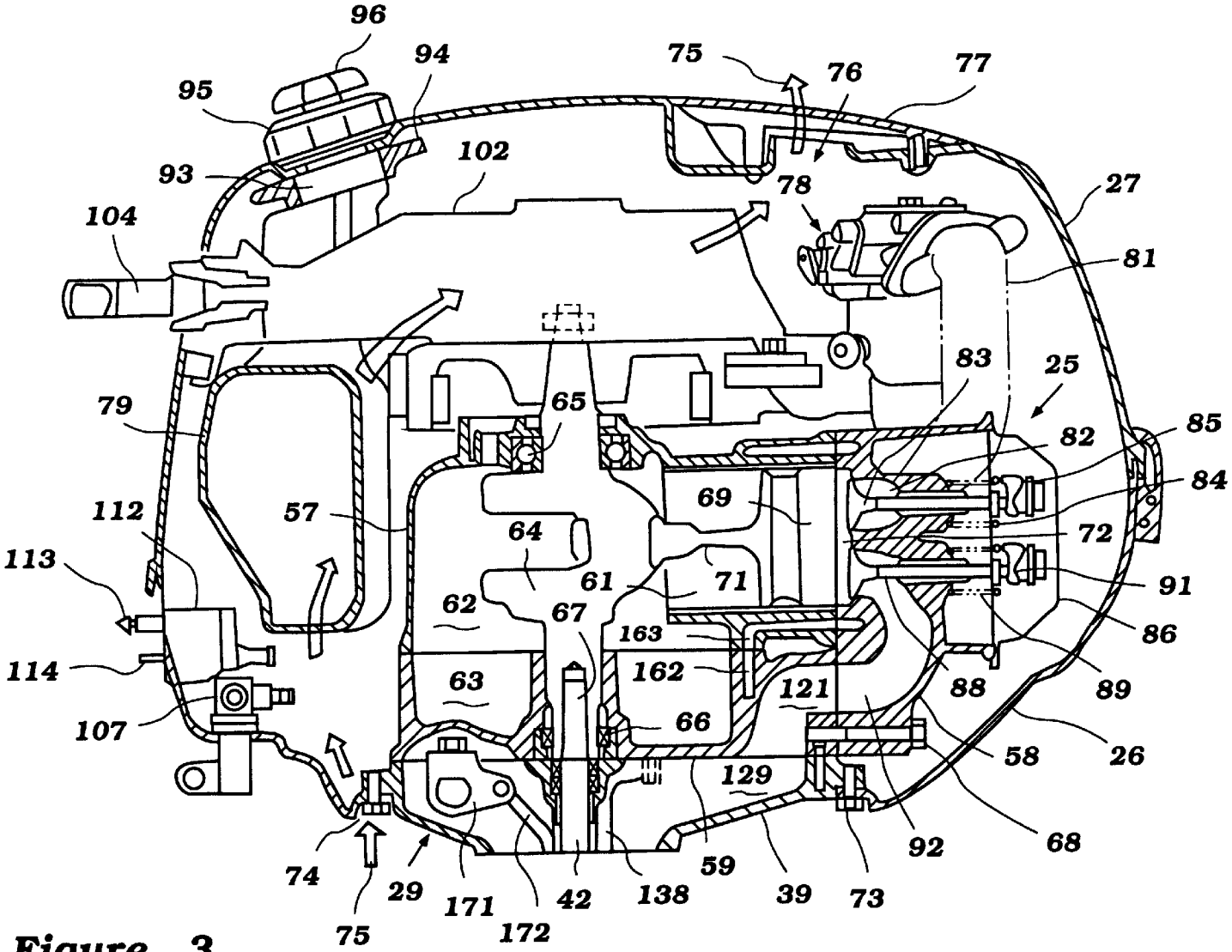
FIG. 3 is an enlarged side elevational view of the power head with portions broken away and shown in section.

The steering support for the outboard motor 21 will now be described in more detail by particular reference to FIGS. 2 and 3. It may be seen in FIGS. 2 and 3 that the drive shaft housing and lower unit 29 is a unitary construction which may be formed from a lightweight material, such as an aluminum alloy or the like. This includes an upper supporting plate portion 39 which is integrally connected to a generally tubular portion 41 that depends downwardly from the powerhead 24 to the lower unit portion 35. A drive shaft 42, which is driven in a manner to be described by the engine 25, extends through this tubular portion 41 and has a bevel gear affixed to its lower end which forms a portion of the bevel gear reversing transmission 36.

The swivel bracket 28 is of a longitudinally split, two-piece construction and has a generally vertically extending cylindrical portion 43 that embraces the drive shaft housing cylindrical portion 41, but is radially spaced outwardly therefrom so as to define an expansion chamber area 44 therebetween, for a purpose which will be described.

This two-piece outer construction defines an upper shoulder 45 and a lower shoulder 46 which extend radially inwardly toward the drive shaft housing tubular portion 41. Split elastic supporting members 47 are interposed between these shoulders 45 and 46 and a downwardly facing shoulder 48 of the upper support plate portion 39 of the drive shaft housing and a lower, upwardly facing shoulder 49 formed at the upper end of the lower drive shaft housing portion 34.

These elastic supporting members 47 are split so as to be inserted around the drive shaft housing cylindrical portion 41 at the upper and lower ends thereof. Split nylon bushings 51 and 52 are placed between the upper and lower ends of these members 47 and the drive shaft housing shoulder 48 and 49, respectively.

The elastic members 47 have face portions 53 that are engaged with the respective bushings 51 and 52. A plurality of lightening holes 54 are formed in the hub portion of the elastic members 47 so as to provide lightening and to increase their resilience.

When the swivel housing 48 is placed together in embracing relationship around these nylon bushings and the elastic members 47, there will be provided an effective journaling of the drive shaft housing 29 in the swivel bracket 28 with gas tight seals formed at opposite ends of the expansion chamber 44 for a purpose which will be described.

A tiller 55 (FIG. 1) is affixed suitably to the tray member 26 of the protective cowling of the powerhead 24 for steering of the outboard motor 21 about the vertically extending axis formed by the swivel bracket 28. In addition, a steering lug 56 may be connected to an upper portion of the drive shaft housing tubular portion 41 for connection to a remote steering mechanism for steering of the outboard motor 21 from a remote location. The swivel bracket 28 and specifically its housing member 43 is provided with a slot so as to accommodate this steering motion.

The construction associated with the powerhead 24 will now be described by particular reference to FIGS. 2 through 10. Referring first to the engine 25, its internal construction is shown best in FIGS. 2 through 8 and will be described by principle reference to those figures. The engine 25 is comprised of an engine body having three main portions. These comprise a cylinder block portion 57, a cylinder head portion 58, and a oil reservoir forming portion 59. These portions are connected together in a manner which will be described.

The cylinder block 57 defines, in this embodiment, a single horizontally extending cylinder bore 61. One end of this cylinder bore is closed by an upper crankcase chamber 62, that is formed primarily by the lower or forward end of the cylinder block member 57 and which is completed by an oil reservoir forming portion 63 of the oil pan forming member 59. This oil pan forming member 59 is affixed to the lower face of the cylinder block 57 in closing relationship to the cylinder block upper crankcase chamber 62.

A crankshaft 64 is rotatably journaled within the crankcase chamber 62 by means of an upper main bearing 65 that is carried in an upper end face of the cylinder block member 59. In addition, a lower main bearing 66 is carried by the crankcase forming member 59 and journals the lower end of the crankshaft 64. This is in proximity a splined coupling 67 between the crankshaft 64 and the upper end of the drive shaft 42.

The cylinder head 28 is affixed to the crankcase forming member 59 and the cylinder block 57 by means of a plurality of threaded fasteners 68. Thus, the opposite end of the cylinder bore 61 is closed by the cylinder head member 58.

A piston 69 is supported for reciprocation in the cylinder bore 61. A connecting rod 71 connects the piston 69 to a throw of the crankshaft 64 upon which the connecting rod 71 is journaled in a well known manner.

The surface of the cylinder head member 59 that faces the cylinder bore 61 and which closes it is formed with a recess 72 that forms the combustion chamber of the engine with the piston 69 and the cylinder bore 61. A fuel air charge is delivered to this combustion chamber by an induction system which will now be described, again primarily referring to FIGS. 3 and 9 through 11.

Air for combustion by the engine 25 is admitted to the interior of the protective cowling in a manner which will be described by principle reference first to FIG. 3. First, it should be noted that the tray portion 29 of the protective cowling is affixed to the upper support plate portion 39 of the drive shaft housing 29 by threaded fasteners 73. The lower area of the tray 26 is provided with an air inlet slot 74 so that atmospheric air may be drawn into the interior of the protective cowling in the air manner shown by the arrows 75 in this figure.

The air flows through the interior of the protective cowling and excess air is discharged through an upwardly facing opening 76 formed in the main cowling member 27. The main cowling member 27 is provided with a cover plate 77 that extends across the opening 76 so as to block direct water entry thereto, but which also has slotted openings for exit of the air back to the atmosphere as shown by the arrows 75. Thus, there is provided water separation while permitting adequate air flow for engine combustion and some cooling.

This air is then delivered to a carburetor 78 which may be of any known type. If desired, an air silencer may be affixed to the inlet of the carburetor 78 for silencing the intake air. The carburetor 78 receives fuel from a fuel tank 79 in a manner which will be described shortly.

The carburetor 78 delivers the formed charge of fuel and air to an intake manifold 81 which communicates with an intake passage 82 formed in the cylinder head 58. This intake passage 82 terminates at an intake valve seat which is valve by an intake valve 83. The intake valve 83 is urged to a closed position by a coil compression spring assembly 84 that acts against a keeper retainer assembly fixed to the stem of the intake valve 83 in a well known manner. The intake valve 83 is opened and by a valve actuating mechanism which includes a rocker arm 85 that is pivotally supported in the cylinder head 58. The valve mechanism described is contained in a valve chamber that is closed by a valve cover 86. The way in which the rocker arm 85 is operated will be described later by principle reference to FIGS. 4–6.

The charge which has been admitted to the combustion chamber recess 72 will be compressed when the piston 69 moves upwardly and then fired at an appropriate time by an ignition system including a spark plug 87. The burnt charge is exhausted through an exhaust valve seat which is valved by a poppet type exhaust valve 88. Like the intake valve 83, the exhaust valve 88 is suitably supported in the valve chamber of cylinder head 58 and is urged to its closed position by a coil compression spring 89. A rocker arm 91 is associated with the exhaust valve 88 for operating it in a known manner. As has been noted the way in which the rocker arm 85 is operated will be described later by principle reference to FIGS. 4–6

When opened, the exhaust gases can exit the combustion chamber through an exhaust passage 92 that is formed in the cylinder head 86. As seen best in FIGS. 3 and 7, the exhaust passage 92 extends through a lower face of the cylinder head 58. There it communicates with an exhaust system formed in initial part by the crankcase forming member 59. This exhaust system will be described later.

The fuel supply system for supplying the fuel to the carburetor 78 from the fuel tank 79 and for permitting filling and charging of the fuel tank 79 will be now described by principle reference to FIGS. 3 and 9 through 11. First, it will be seen that the fuel tank 79 has a filler neck portion 93 which extends upwardly toward an opening in the main cowling member 27. A sealing gasket 94 provides a seal between the fill neck 93 and the cowling member 27.

A fill cap 95 is threadedly connected to the upper end of the fill neck 93 externally of the protective cowling member 27. This fuel cap 95 also has an air vent valve 96.

The fuel tank 79 has a pair of spaced apart boss sections 97 formed on its opposite sides which are juxtaposed to respective lugs 98 formed on the cylinder block member 57. Elastic grommets 99 (FIG. 11) are interposed between the lugs 97 and 98 and threaded fasteners 101 that mount the fuel tank 79 to the cylinder block 57.

In addition, a recoil starter cover 102 also has lugs 103 that are affixed to the cylinder block 97 by the same threaded fasteners 101. This recoil starter has assembly 102 has a pull handle 104 that is accessible from the exterior of the protective cowling member 27 for pull starting of the engine 25 in a well known member. In addition, a fly wheel magneto (not shown) may be also associated with the pull starter for generating electrical power for firing the spark plugs 87.

Continuing to refer to the fuel supply system, the fuel tank 79 has a discharge port 105 that communicates with a first supply conduit 106. This conduit 106 is connected to a combined shut off, drain valve 107 which, in turn, communicates with a supply line 108. This supply line 108 extends to an engine driven fuel pump 109. The fuel pump 109 will deliver fuel under pressure to the carburetor 78 through a supply conduit 111.

Since the fuel tank 79 is mounted within the protective cowling, it will have a relatively small volume. Therefore, an external source of fuel may also be provided for supplying fuel to the engine. This external supply includes a quick disconnect coupling 112 that is mounted on the tray 26 as best seen in FIG. 3. This coupling 112 includes a quick disconnect shut off valve 113 and a locating pin 114 so as to cooperate with a female coupling that can be connected to a remote fuel tank in a well known manner.

This assembly coupling and valve assembly is further mounted on a mounting boss 115 of the crankcase forming member 59 by means of a mounting bracket 116 and threaded fastener 117. A conduit 118 connects the quick disconnect coupling 112 with the shut off and drain valve 107 and, accordingly, with the tank 79.

Figure 13:
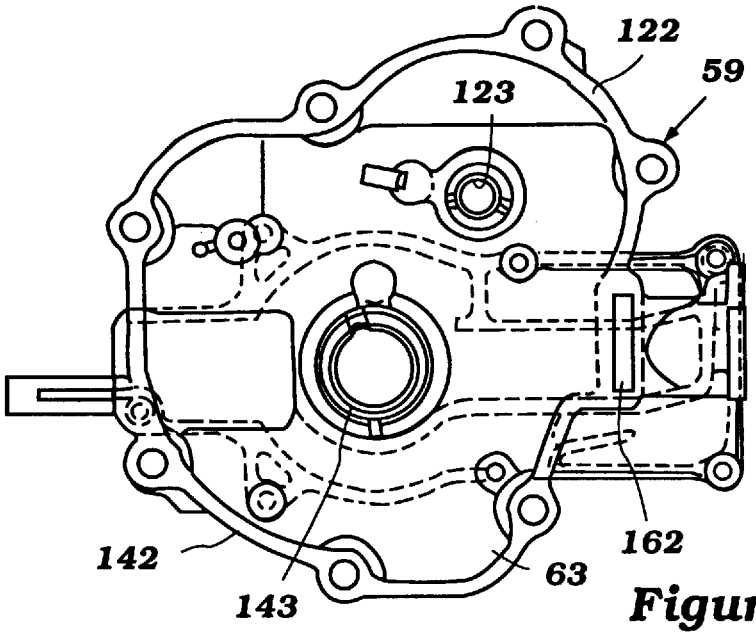
FIG. 13 is a top plan view showing the configuration of a portion of the crankcase chamber forming member and specifically the oil reservoir therefore.
Figure 14:
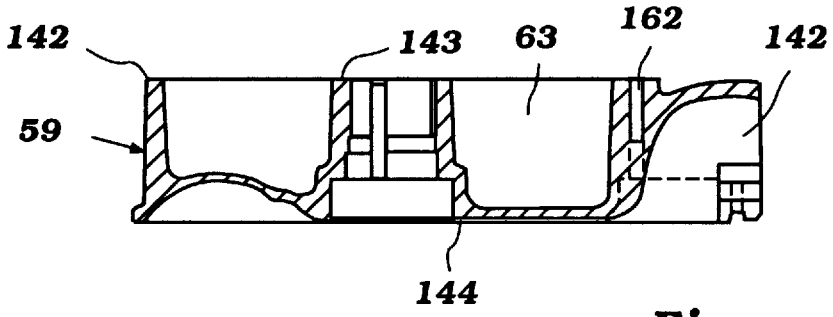
FIG. 14 is a cross-sectional view of this component.
Figure 15:
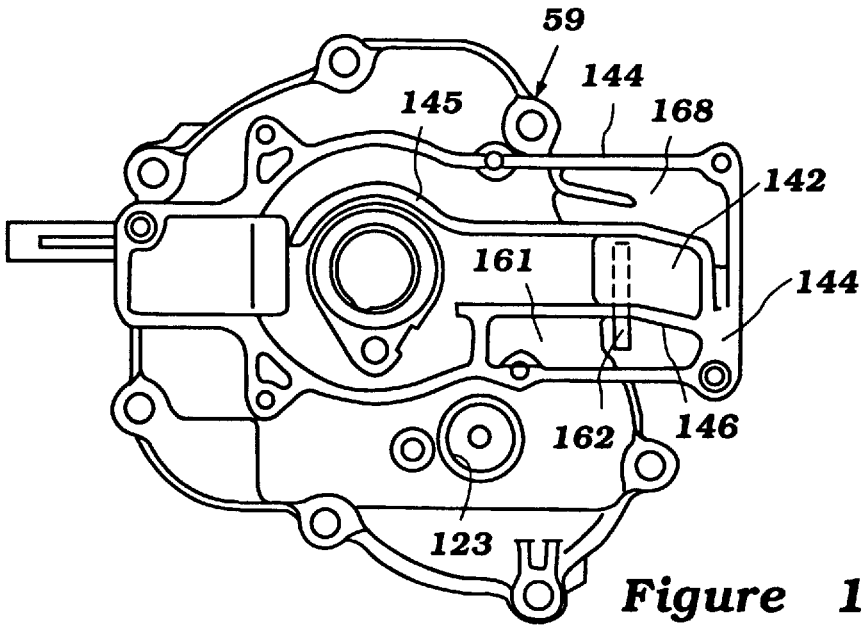
FIG. 15 is a bottom plan view of this component.

The valve operating and lubricating system will now be described by primary reference to FIGS. 3–8. A camshaft 119 is rotatably journaled within the crankcase chamber 62 by suitable bearings formed at its opposite ends. This journaling structure is shown in FIG. 5 with the crankshaft ends being indicated at 121 and 122. The upper end 121 is journaled for rotation in the cylinder block member 58. The lower end 122 is journaled for rotation in an appropriate bearing formed in the upper end of the oil pan forming member 59 which bearing appears in FIGS. 13 and 15, and is identified by the reference numeral 123 therein.

Figure 4:
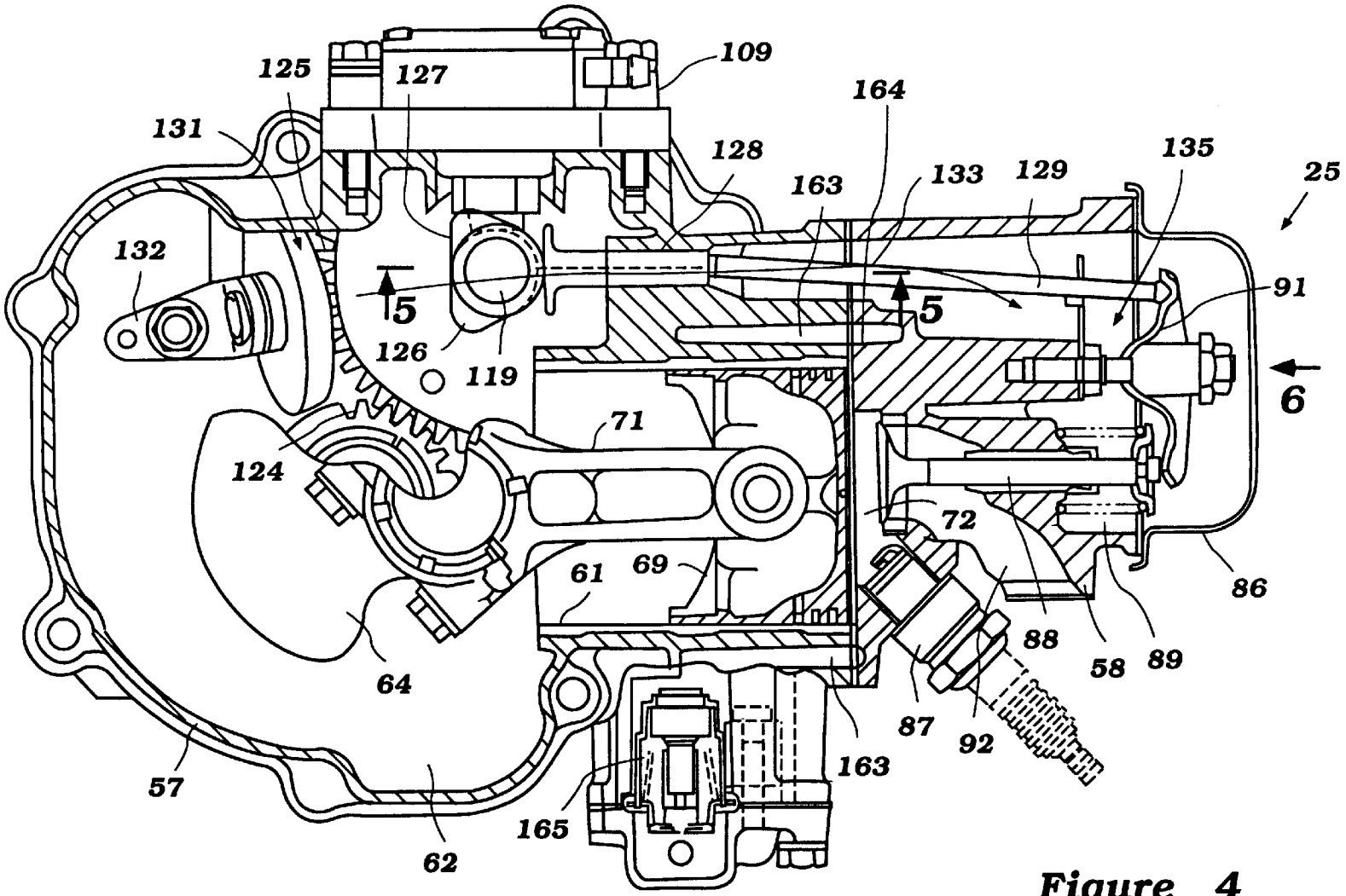
FIG. 4 is a cross-sectional view taken through the engine of the power head taken along a plane perpendicular to the plane of FIG. 3 and passing through the center of the cylinder bore.
Figure 5:
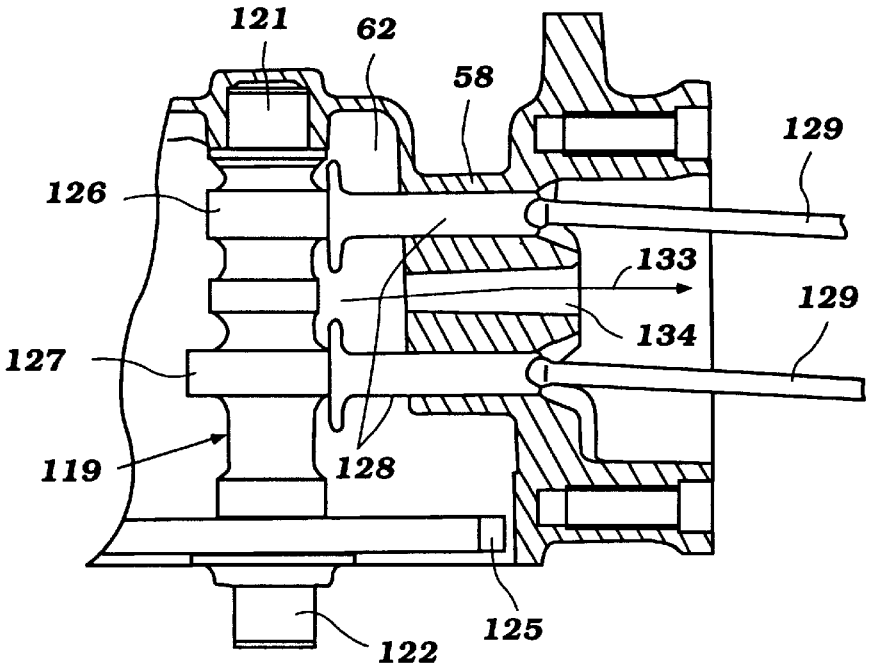
FIG. 5 is a cross-sectional view taken along the line 5—5 of FIG. 4 and shows the valve operating mechanism and the mechanism by which lubricant from the splash lubrication system is delivered to the valve chamber of the cylinder head.
Figure 6:
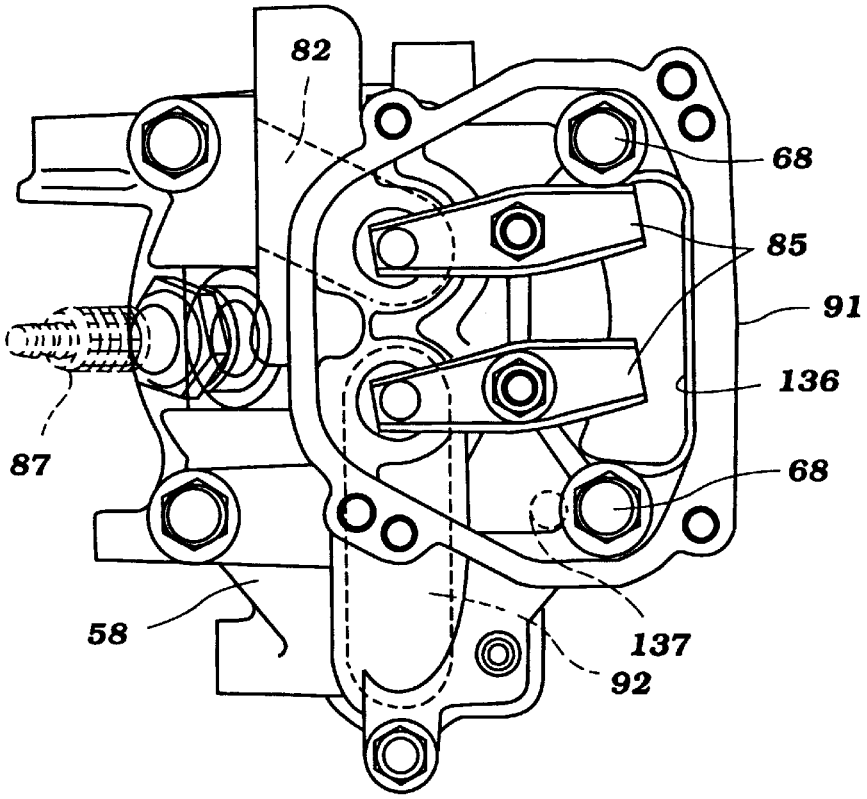
FIG. 6 is a view of the valve chamber of the cylinder head looking in the direction of the arrow 6 in FIG. 4 and with the valve cover removed.

The camshaft 119 is driven at one-half crankshaft speed by a timing mechanism which appears in FIG. 4. This includes a drive gear 124 that is fixed for rotation with the crankshaft 64 and a driven gear 125 that is fixed for rotation with the camshaft 119 at its lower end.

The camshaft 119 is provided with a pair of cam lobes 126 and 127 for operating the intake valve 83 and exhaust valve 88, respectively through their respective rocker arms 85 and 91. A pair of tappets 128 are slidably supported within the cylinder block member 85 and cooperate with respective push rods 129. Each push rod 129 is associated with a respective one of the rocker arms 85 and 91 for operating it in a manner well known in the art.

It should be noted also that the fuel pump 109 may be driven off of a further lobe on the camshaft 119.

An oil slinger gear, indicated by the reference numeral 131, is mounted for rotation in an area proximate to the oil level in the oil reservoir 63 on a mounting bracket 132. This oil slinger gear 131 is in mesh with the camshaft drive gear 123 but rotates about a transverse axis relative to it. Oil will be thrown by the gear 131 into the crankcase chamber 62 and in contact with not only the crankshaft 64, camshaft 119, and their bearings but also in a direction indicated by the arrow 133.

This flow direction is, as best shown in FIG. 5, toward an opening 134 formed in the wall in which the tappets 128 are slidably supported. This opening 134 opens into the valve chamber, indicated generally by the reference numeral 135 in which the valve actuating mechanism comprised of the rocker arms 85 and 91 are contained. It should be noted that the lower surface of the cylinder head is formed with an enlarged opening 136 that is disposed above the cylinder block opening 133 and through which the slung oil may easily pass.

Figure 8:
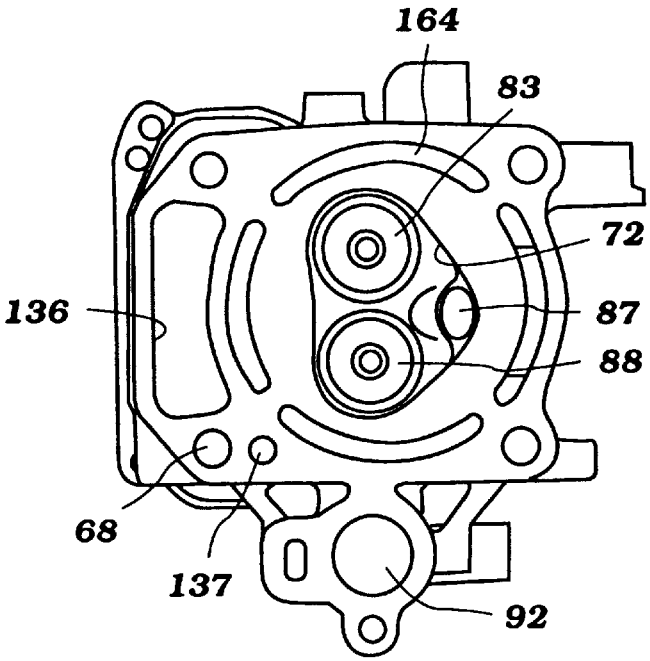
FIG. 8 is a view showing the surface of the cylinder head which mates with the portion of the cylinder block shown in FIG. 7.

This oil will collect at a low portion in the valve chamber 135 where it can flow through a return passage 137 formed in the lower cylinder head surface, as also seen in FIG. 8. This oil return passageway communicates with a return passageway 138 that is formed in the cylinder block 57 and which communicates with the crankcase chamber 62. This returned oil may then fall into the oil reservoir 63 to be recirculated. An arrangement, to be described, is also provided for ensuring cooling of this returned oil.

It has been noted that the exhaust gases from the cylinder head exhaust port 92 are discharged to the atmosphere through an exhaust system. That exhaust system will now be described by primary reference to FIGS. 2, 3, 6 through 8 and 12 through 15. Initial reference will be made to FIGS. 6 and 8 and 12 through 15, which describe the structure by which the exhaust gases are collected from the cylinder head exhaust passage 92 and are delivered to an elongated expansion chamber 139 that is formed in major part in the tubular portion 41 of the drive shaft housing and lower unit outer housing 29.

It has already been noted that the cylinder head assembly 58 is detachably connected to the crankcase forming member 59. This crankcase forming member 59 is formed with an exhaust collector passage 141 in one side thereof, as best seen in FIGS. 6 and 9 through 11. This exhaust collector passage 141 has an inlet portion that communicates with the discharge end of the cylinder head exhaust passage 92 and then curves downwardly. This is disposed to one side of the oil reservoir portion 63 of this member 59. The member 59 has an upper surface 142 that is affixed in sealing relationship with a downwardly facing surface of the cylinder block 57 and particularly the portion that forms the upper crankcase chamber 61.

It should be noted that oil is maintained in the reservoir 63. The aforenoted splash type lubricating system delivers this oil to the various components of the engine 25 as already noted. The crankcase chamber forming member 59 also has a cylindrical center boss 143 in which the bearing 66 is supported.

It will be seen that the lower face 144 of the crankcase forming member 59 is formed with a pair of rib-like portions 145 and 146 that define a path for the exhaust gases. These rib-like portions 145 and 146 cooperate with respective rib-like portions 147 and 148 formed in the upper portion of the supporting plate section 39 of the drive shaft housing 29 as best seen in FIG. 8.

Figure 12:
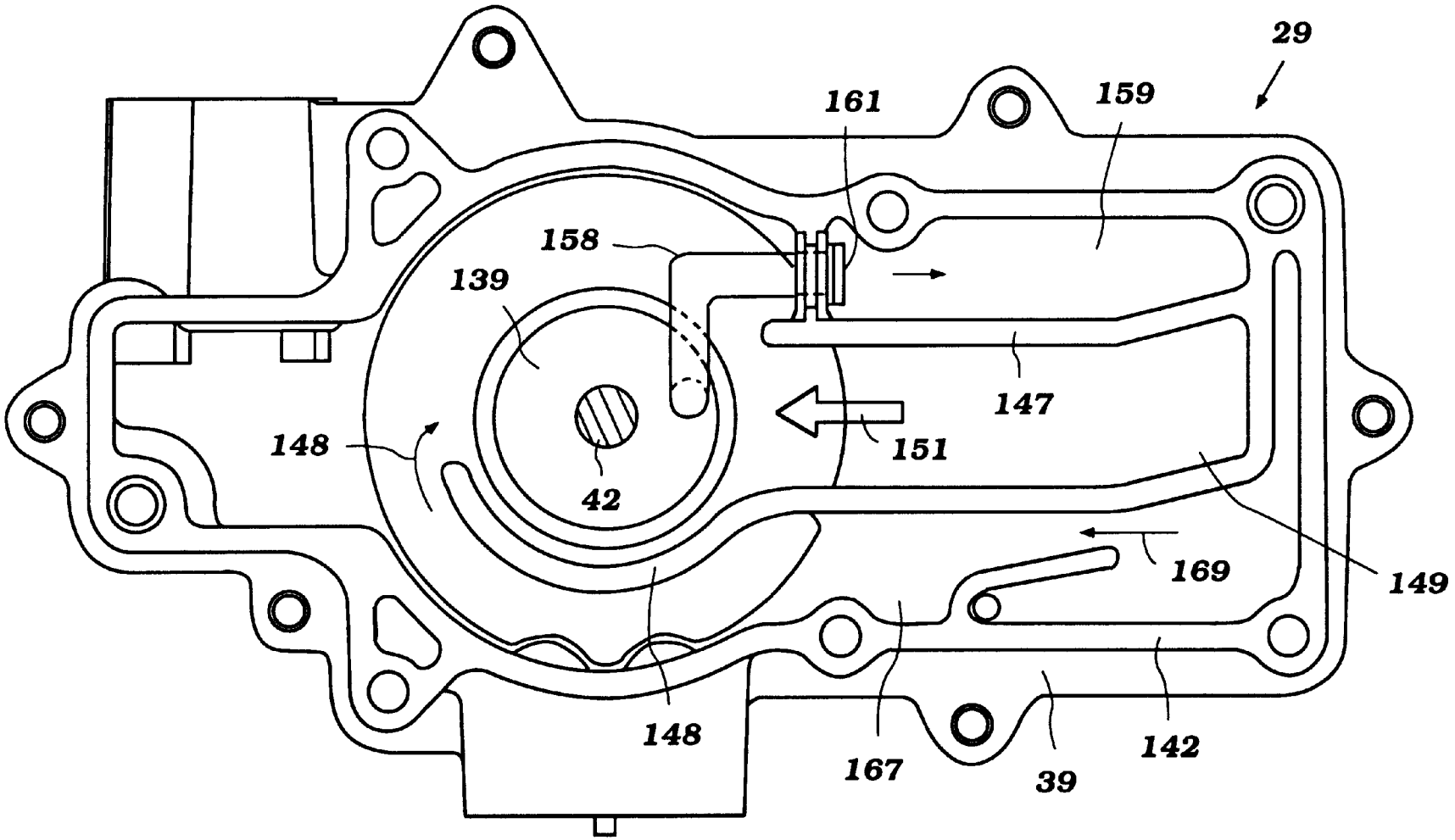
FIG. 12 is a top plan view showing the support plate portion of the drive shaft housing for the engine in the power head.

These cooperating rib-like portions 145 and 148 and 146 and 147 define an exhaust passageway 149 so that the exhaust gases will flow as shown by the arrow 151 in FIG. 12 toward the expansion chamber opening 139 formed by the drive shaft housing cylindrical portion 41.

After flowing through the aforenoted relatively restricted path, the exhaust gases can expand in the expansion chamber volume 139 to provide a silencing effect. The exhaust gases then are discharged to the atmosphere through a path which is shown best in FIG. 2.

It should be noted that the lower unit housing 35 also is provided with an expansion chamber portion 152 in which a further expansion of the exhaust gases may take place. The lower unit 35 is provided with an under water exhaust gas discharge 153 from which these exhaust gases may exit. This occurs when the watercraft is in a planing condition and this discharge 153 is relatively shallowly submerged.

However, when operating at idle or when the watercraft is stationary and the engine running as shown in FIG. 1, this discharge opening 153 will be deeply submerged. Also, the pressure of the exhaust gases will be relatively low. Thus, there is provided a low speed exhaust gas discharge path that is less restricted under this condition but which will also provide added silencing. This system is shown best in FIG. 2.

As may be seen in this figure, the tubular portion 41 of the drive shaft housing 29 is provided with a restricted exhaust gas discharge opening 154. This opening 154 is positioned proximately to the lower steering support of the drive shaft housing 29 provided by the elastic member 47. From this opening 154, the exhaust gases may pass into the aforenoted expansion chamber 44 formed in the area between the swivel bracket portion 43 and the cylindrical portion 41 of the drive shaft housing 29. Thus, a further expansion will occur that will assist in the silencing.

An upper portion of the swivel bracket 28 is provided with an above the water exhaust gas discharge opening 155 through which these exhaust gases may pass to the atmosphere. Thus, even when operating at low speeds, there will be an effective discharge of the exhaust gases and silencing of them. However, when traveling at high speeds, the size of the discharge openings 154 and 155 will restrict any substantial flow of exhaust gases from this low speed path.

It has been noted that the engine 25 is water cooled. That water cooling system will now be described by principle reference to FIGS. 1 through 4, 7 and 12 through 16. Also, the following description will explain how the water cooling system cooperates with the lubricating system including the oil reservoir 63 and the exhaust system so as to assist in maintaining the engine and its fluids at the correct temperature and also so as to assist in the exhaust silencing.

First, it should be noted that the lower unit housing portion 35 is provided with a gill-like opening 156 (FIG. 1) through which water may be drawn by a water pump 157 (FIG. 2) that is driven off of the drive shaft 42 in a well-known manner. This water under pressure is then pumped upwardly through a water delivery tube 158 that passes through the drive shaft housing cylindrical portion 41.

Figure 16:
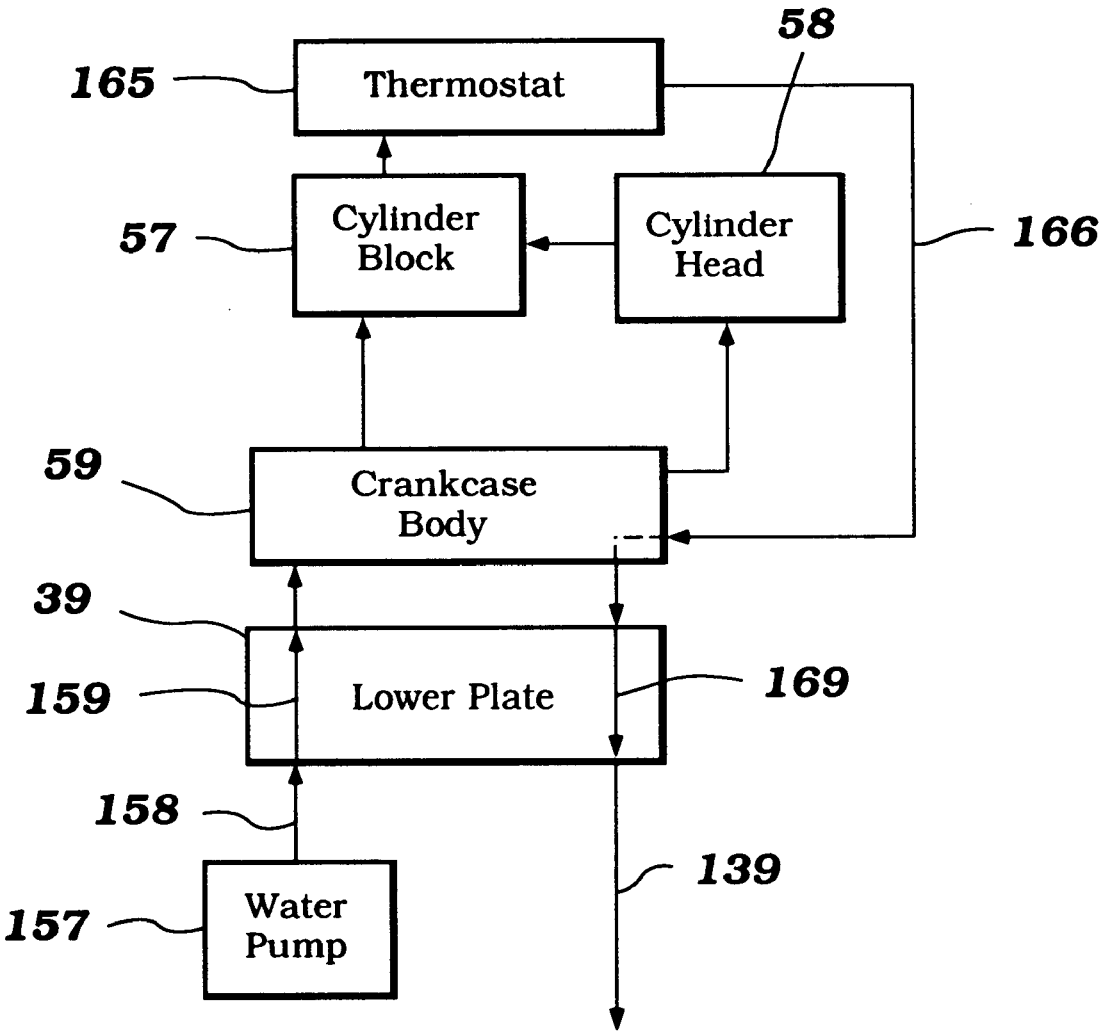
FIG. 16 is a schematic view showing the flow of cooling water through the outboard motor and its return back to the body of water in which the watercraft is operating.

As shown schematically in FIG. 16 and in actual construction in FIG. 12, this coolant is then delivered to a cooling jacket portion 159 that is formed in the upper surface of the drive shaft housing supporting plate portion 39. The conduit 158 has a discharge fitting 161 that communicates with this portion 159. It should be noted that the portion 159 is formed by the rib 147 that defines the exhaust gas passage 149 and the upper surface 142 of this drive shaft housing portion 39.

Flow of water through the portion 159 also communicates with a water supply path 161 (FIG. 15) formed by the lower portion of the crankcase forming member 59. This oil pan forming member water passage 161, in turn, communicates with a slotted passage 162 that extends upwardly and which communicates with an inlet opening formed in a cylinder block cooling jacket portion which is shown best in FIG. 3 and which is identified by the reference numeral 163. Thus, water can flow from this member directly into the cylinder block cooling jacket 163 and also into a communicating cooling jacket of the cylinder head 58. This water path to the cylinder head cooling jacket is through slotted passages 164 formed in the lower face of the cylinder head (FIG. 8).

Figure 9:
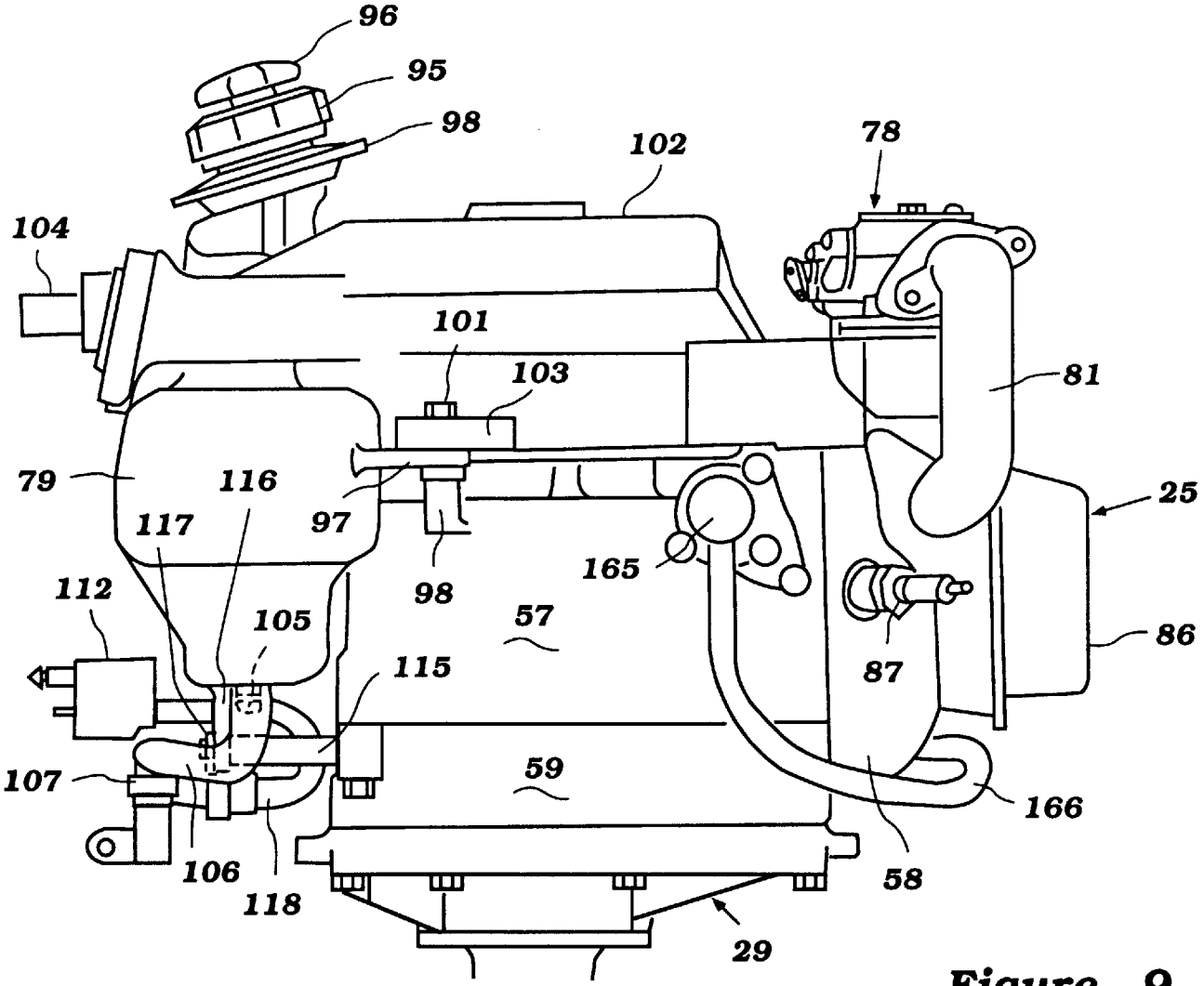
FIG. 9 is a side elevational view looking in the same direction as FIG. 3, but showing only the outer peripheral configuration of the powering internal combustion engine.
Figure 11:
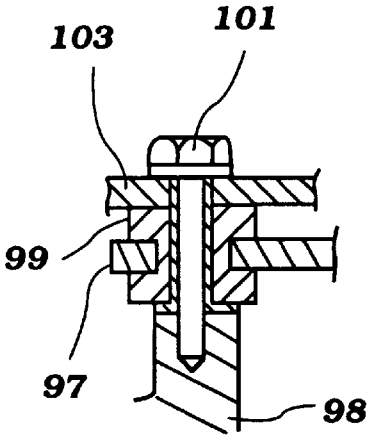
FIG. 11 is an enlarged cross-sectional view showing one of the supports for the fueltank.
Figure 10:
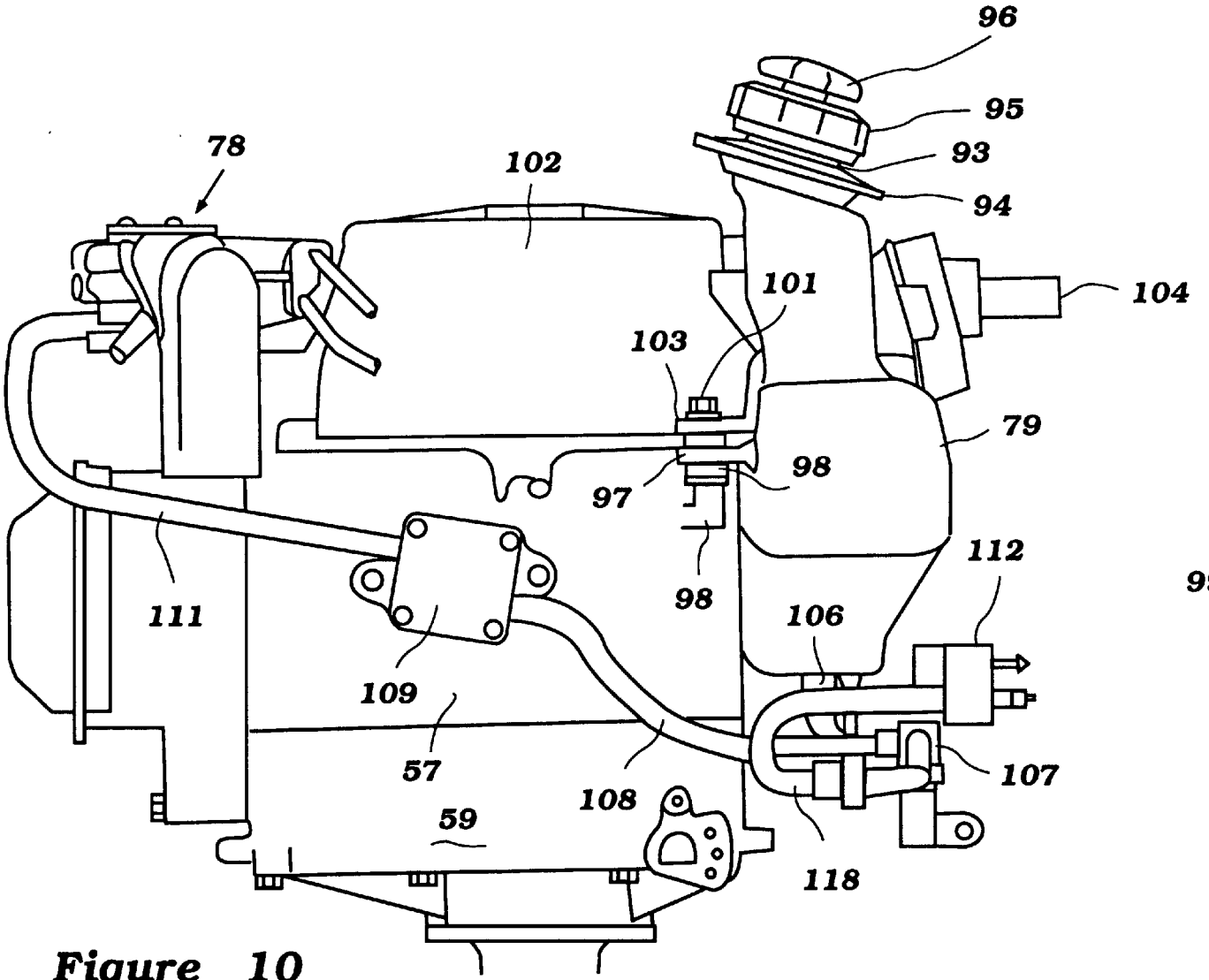
FIG. 10 is a side elevational view of the engine looking from the side opposite to FIG. 9.

As seen in FIGS. 4 and 9, a thermostat housing and thermostat assembly 165, which is shown schematically in FIG. 16, permits the discharge of coolant from the cylinder block and cylinder head cooling jackets back to a discharge passageway formed in the crankcase forming member 59 and supporting plate portion 39 of the drive shaft housing 28. This includes an external return conduit 166.

This return conduit 165 communicates with a water return passageway 167 formed in the drive shaft housing support plate portion 39 and which is closed by a cooperating passage portion 168 formed in the lower surface of the oil pan forming member 59. This return water path, indicated by the arrows 169 flows along the opposite side of the exhaust passage 149 and thus further assists in the cooling of the exhaust gases.

This water is then dumped into the expansion chamber area 139 of the drive shaft housing cylindrical portion 41 for discharge back to the body of water in which the watercraft is operating through the under water exhaust gas discharge 133. This water will drain through this path under all running conditions since back pressure is not a problem with respect to the water discharge.

Figure 7:
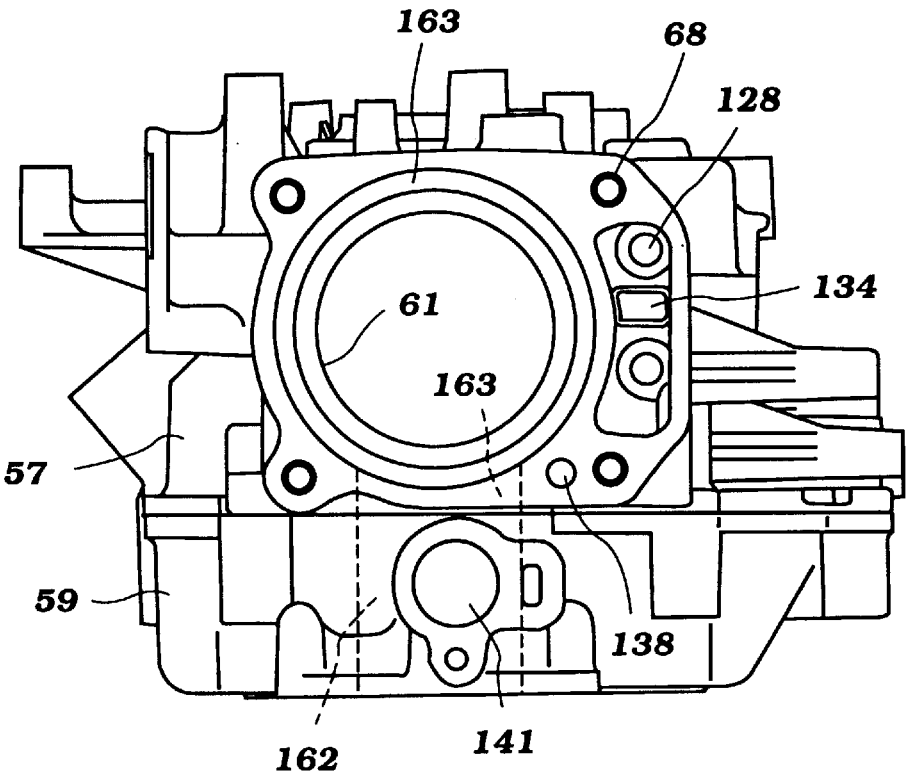
FIG. 7 is a view showing the cylinder block with the cylinder head removed.

It should be apparent that the cooling water flows around the oil reservoir 63 and thus provides good cooling of it. In addition, the lubricating oil that is returned to the oil reservoir 63 through the cylinder head and cylinder block drain passages 137 and 138 will also be cooled. This is because these passages are formed in proximity to the cooling water inlet opening 162 into the cylinder head and cylinder block as best seen in FIGS. 7 and 8. Thus, this oil will be cooled by the water when it is first admitted to the engine cooling jackets and is at its lowest temperature. Thus, the oil temperature will be kept quite low.

The mechanism for shifting the transmission 36 will finally be described by reference to FIGS. 2 and 3. A shift lever 171 is pivotally supported on the supporting plate portion 39 of the drive shaft housing 29. This lever 171 is operated by a suitable, externally positioned shift lever. A shift link 172 is pivotally connected to an arm of the shift lever 171. This shift link 172 depends into the drive shaft housing portion 34 and lower unit 35 to operate a shift cam (not shown) that operates the dog clutches of the transmission 36 in a well known manner.

Thus, it should be readily apparent from the foregoing description that the described system provides a very effective exhaust gas silencing, a simple structure for forming the various exhaust passages which minimizes the number of seals that may meet the form, and also which provides a very effective flow of coolant to and from the engine while cooling not only the exhaust gases but also the oil pan and the oil returned to it after lubricating the engine components. Of course, the foregoing description is that of a preferred embodiment of the invention and various changes and modifications may be made without departing from the spirit and scope of the invention, as defined by the appended claims.

What is claimed is:

1. A four-stroke internal combustion engine having a crankcase chamber containing a crankshaft, a cylinder head and a cylinder block, a valve actuating mechanism contained in said cylinder head for operating valves associated with a horizontally extending cylinder bore formed in said cylinder block, said valve actuating mechanism being contained within a valve chamber defined by a valve cover attached to said cylinder head, a lubrication system for delivering lubricant to said valve actuating mechanism comprising a splash system including an oil slinger driven from said crankshaft and contained in said crankcase chamber, an oil return passage extending from said cylinder head through said cylinder block to said crankcase chamber for returning lubricant to said crankcase chamber from said valve chamber, said engine being provided with a cooling jacket, and means for introducing liquid coolant to said cooling jacket through a coolant delivery passage disposed in proximity to said oil return passage for cooling the returned oil.

2. A four-stroke internal combustion engine as set forth in claim 1 wherein the valve actuating mechanism comprises push rods operated by a cam shaft contained in the crankcase chamber and operating the valves through rocker arms journaled in the valve chamber, and the cylinder head and cylinder block form a push rod passage through which the push rods extend and through which oil thrown by the oil slinger can reach the valve chamber.

3. A four-stroke internal combustion engine as set forth in claim 2 wherein the push rod passage extends above the cylinder bore and the oil return passage lies below the cylinder bore.

4. A four-stroke internal combustion engine having a crankcase chamber, a cylinder head and a cylinder block, a valve actuating mechanism contained in said cylinder head for operating valves associated with a cylinder bore formed in said cylinder block, said valve actuating mechanism being contained within a valve chamber defined by a valve cover attached to said cylinder head, a lubrication system for delivering lubricant to said valve actuating mechanism, an oil return passage extending from said cylinder head through said cylinder block to said crankcase chamber for returning lubricant to said crankcase chamber from the valve chamber, said engine being provided with a cooling jacket, and means for initially introducing liquid coolant to said cooling jacket through a coolant delivery passage disposed in proximity to said oil return passage for cooling the returned oil.

5. A four-stroke internal combustion engine as set forth in claim 4 wherein the cylinder bore has a horizontally extending axis.

6. A four-stroke internal combustion engine as set forth in claim 4 wherein the a cylinder block that defines an upper portion of the crankcase chamber, and further including an oil pan forming member affixed to said cylinder block and defining an oil reservoir, a closure member fixed to the underside of said oil pan forming member.

7. A four-stroke internal combustion engine as set forth in claim 6 wherein the cylinder head member is affixed to the cylinder head and to the oil pan forming member.

8. A four-stroke internal combustion engine as set forth in claim 7 wherein the cylinder bore has a horizontally extending axis.

9. A four-stroke internal combustion engine as set forth in claim 8 wherein the engine is lubricated by a splash system including an oil slinger driven from the crankshaft and contained in the crankcase chamber.

10. A four-stroke internal combustion engine as set forth in claim 9 wherein the valve actuating mechanism comprises push rods operated by a cam shaft contained in the crankcase chamber and operating the valves through rocker arms journaled in the valve chamber, and the cylinder head and cylinder block form a push rod passage through which the push rods extend and through which oil thrown by the oil slinger can reach the valve chamber.

11. A four-stroke internal combustion engine as set forth in claim 10 wherein the push rod passage extends above the cylinder bore and the oil return passage lies below the cylinder bore.

12. A four-stroke internal combustion engine as set forth in claim 11 wherein the cooling jacket delivery passage extends through the oil pan forming member.

* * * * *